US011542818B2

(12) United States Patent
Theander et al.

(10) Patent No.: US 11,542,818 B2
(45) Date of Patent: Jan. 3, 2023

(54) VEHICULAR WORK MACHINE AND METHOD FOR VEHICULAR WORK MACHINE WATER CONTROL

(71) Applicant: HUSQVARNA AB, Huskvarna (SE)

(72) Inventors: Fredrik Theander, Stenkullen (SE); Tommy Olsson, Lerum (SE)

(73) Assignee: HUSQVARNA AB, Huskvarna (SE)

( * ) Notice: Subject to any disclaimer, the term of this patent is extended or adjusted under 35 U.S.C. 154(b) by 123 days.

(21) Appl. No.: 16/477,296

(22) PCT Filed: Jan. 3, 2018

(86) PCT No.: PCT/SE2018/050002
§ 371 (c)(1),
(2) Date: Jul. 11, 2019

(87) PCT Pub. No.: WO2018/132054
PCT Pub. Date: Jul. 19, 2018

(65) Prior Publication Data

US 2020/0032651 A1 Jan. 30, 2020

(30) Foreign Application Priority Data

Jan. 11, 2017 (SE) ..... 1750014-1

(51) Int. Cl.
*E21F 5/02* (2006.01)
*B05B 12/00* (2018.01)
(Continued)

(52) U.S. Cl.
CPC ..... *E21F 5/02* (2013.01); *B05B 12/002* (2013.01); *E02F 3/966* (2013.01); *E02F 9/205* (2013.01);
(Continued)

(58) Field of Classification Search
CPC ..... E21F 5/02; E21F 5/04; E02F 3/966; E02F 9/205; E02F 3/965; E02F 3/963;
(Continued)

(56) References Cited

U.S. PATENT DOCUMENTS 4,691,967 A 9/1987 Schupphaus
4,854,393 A 8/1989 Palet
(Continued)

FOREIGN PATENT DOCUMENTS

CN 105484303 A 4/2016
EP 1287899 A1 3/2003
(Continued)

OTHER PUBLICATIONS

International Search Report and Written Opinion for International Application No. PCT/SE2018/050002 dated Apr. 11, 2018.
(Continued)

*Primary Examiner* — Qingzhang Zhou
(74) *Attorney, Agent, or Firm* — Burr & Forman LLP

(57) ABSTRACT

The present disclosure relates to a vehicular work machine (10) that is adapted for handling at least two different interchangeable tools (4). The machine (10) also comprises a user control device (11) and a water supply arrangement (31) that is adapted to distribute water for retaining dust that is created when a tool (4) is used, The water supply
(Continued)

arrangement (31) comprises a controllable valve (24) that is arranged to control the flow of the water that is distributed via at least one nozzle (29). The user control device (11) is arranged for selection of a desired tool, where at least one selectable tool is associated with a certain predefined water setting. Each water setting relates to a certain relative flow of distributed water during a certain time that is related to the time said tool (4) is chosen and performing a certain work procedure, and/or to the time said tool (4) is chosen and ready to perform a certain work procedure.

8 Claims, 3 Drawing Sheets

(51) Int. Cl.

| | |
|---|---|
| ***E02F 3/96*** | (2006.01) |
| ***E02F 9/20*** | (2006.01) |
| ***E04G 23/08*** | (2006.01) |
| ***E21B 7/02*** | (2006.01) |

(52) U.S. Cl.
CPC ..... *E04G 23/082* (2013.01); *E21B 7/02* (2013.01); *B05B 12/00* (2013.01)

(58) Field of Classification Search
CPC ..... E02F 9/085; E02F 9/2004; B05B 12/002; B05B 12/00; B05B 12/02; E04G 23/082; E04G 23/08; E21B 7/02
See application file for complete search history.

(56) References Cited

U.S. PATENT DOCUMENTS

| | | | | |
|---|---|---|---|---|
| 6,061,617 | A * | 5/2000 | Berger | A01B 63/10 700/18 |
| 8,428,791 | B2 | 4/2013 | Carlsson | |
| 2016/0047241 | A1 * | 2/2016 | Kuiper | E21F 5/02 299/1.05 |
| 2016/0347321 | A1 | 12/2016 | Ge et al. | |

FOREIGN PATENT DOCUMENTS

| | | | |
|---|---|---|---|
| FR | 3027426 | A1 | 4/2016 |
| GB | 2026895 | A | 2/1980 |
| JP | H08246688 | A | 9/1996 |
| JP | H09100636 | A | 4/1997 |
| JP | H10238140 | A | 9/1998 |
| JP | 2002161692 | A | 6/2002 |
| JP | 2005171517 | A | 6/2005 |
| JP | 2009148690 | A | 7/2009 |
| JP | 2012036666 | A | 2/2012 |
| KR | 2005081650 | A | 8/2005 |
| KR | 20100005659 | U | 6/2010 |

OTHER PUBLICATIONS

International Preliminary Report on Patentability for International Application No. PCT/SE2018/050002 dated Jul. 16, 2019.

* cited by examiner

VEHICULAR WORK MACHINE AND METHOD FOR VEHICULAR WORK MACHINE WATER CONTROL

TECHNICAL FIELD

This present disclosure relates to a vehicular work machine comprising a controllable arm arrangement that in turn comprises at least two articulated arm parts and is adapted for handling at least two different interchangeable tools. The vehicular work machine also comprises a user control device and a water supply arrangement that is adapted to distribute water with the purpose of retaining dust that is created when a tool is used.

BACKGROUND

Machines referred to as demolition robots are remote-controlled working machines intended for different demolition operations, in which the operator walks beside the machine and controls its different movements. He does this using a remote control that has two control sticks and a series of different buttons and knobs. The machine is used in several different working modes. It is first moved up to the working surface, e.g. a wall, to be demolished. Its support legs are then lowered so that the machine stands steady. This is a set-up mode. The actual demolition work then begins in a work mode.

Remote demolition robots are often put to work in various materials and using different tools. Very often, the work gives rise to a lot of dust that is created when a tool is working on an object that is to be demolished. For example, concrete dust is unhealthy to breathe and also impairs visions making it difficult for a person controlling the demolition robot to see what is happening at the moment. It is therefore desired to minimize the creation of such dust that freely may expand in the air. Such free concrete dust can affect components of a demolition robot in a negative way, may cause undesirable health effects and generally pollutes the environment.

Some remote demolition robots are for this purpose equipped with a water supply, where a flow of water is directed towards the tool in question in such a way that a large quantity of the dust is mixed with the water and thus retained and kept from expanding in the air. This principle is for example disclosed for an excavating and crushing machine in the document JPH 09100636 where water nozzles are positioned on a tool, where the water supply may be turned on and off by means of a switch.

It is now desired to provide an enhanced control of such a water flow, for example enabling the flow of water to be held at a minimum while maintaining a proper function.

There is thus a need for an enhanced control of a dust retaining water flow for a remote demolition robot or any other suitable vehicular work machine.

SUMMARY

The object of the present disclosure relates to providing enhanced control of a dust retaining water flow for a remote demolition robot or any other suitable vehicular work machine.

This object is obtained by means of a vehicular work machine comprising a controllable arm arrangement that in turn comprises at least two articulated arm parts and is adapted for handling at least two different interchangeable tools. The vehicular work machine also comprises a user control device and a water supply arrangement that is adapted to distribute water with the purpose of retaining dust that is created when a tool is used. The water supply arrangement comprises a controllable valve that is arranged to control the flow of the water that is distributed via at least one nozzle. The user control device is arranged for selection of a desired tool, where at least one selectable tool is associated with a certain predefined water setting. Each water setting relates to a certain relative flow of distributed water during a certain time that is related to the time said tool is chosen and performing a certain work procedure, and/or to the time said tool is chosen and ready to perform a certain work procedure. Said certain relative flow of distributed water corresponds to at least an open controllable valve or a closed controllable valve.

This object is also obtained by means of a method for vehicular work machine water control, where water is distributed in a controlled manner and used for retaining dust that is created by the work machine when one of at least two interchangeable tools is used. The method comprises selecting a desired tool, where at least one selectable tool is associated with a certain predefined water setting, where each water setting relates to a certain relative flow of distributed water during a certain time that is related to the time a tool is chosen and performing a certain work procedure, and/or to the time said tool is chosen and ready to perform a certain work procedure.

According to an example, the user control device is arranged for inputting and saving at least two different water settings for each of said tools.

According to another example, for a certain water setting, there is a relative flow of distributed water during a certain extension time after a certain stop time, after which stop time the work procedure is no longer being performed.

According to another example, said water settings include at least two of:

- "Water on", where the controllable valve is in an open state when a tool is chosen and said tool is enabled and ready for work, or in work.
- "Water off", where the controllable valve always is in a closed state.
- "Water auto close", where the controllable valve is in an open state only when an openable and closable tool is controlled to close, otherwise in a closed state.
- "Water auto open/close", where the controllable valve is in an open state both when an openable and closable tool is controlled to open and when it is controlled to close, otherwise in a closed state.
- "Water auto", where the controllable valve is in an open state only when a tool is activated, otherwise in a closed state.
- "Nozzle setting", where the nozzle is controlled such that different spray configurations are obtained.

Other examples are disclosed in the dependent claims.

The present disclosure brings a plurality of advantages. Mainly, an enhanced control of a dust retaining water flow is provided, where a tailored water flow is enabled for each available tool, possibly also with respect to the present water supply.

BRIEF DESCRIPTION OF DRAWINGS

The present disclosure will now be described more in detail with reference to the accompanying figures wherein.

DETAILED DESCRIPTION

Figure 1:
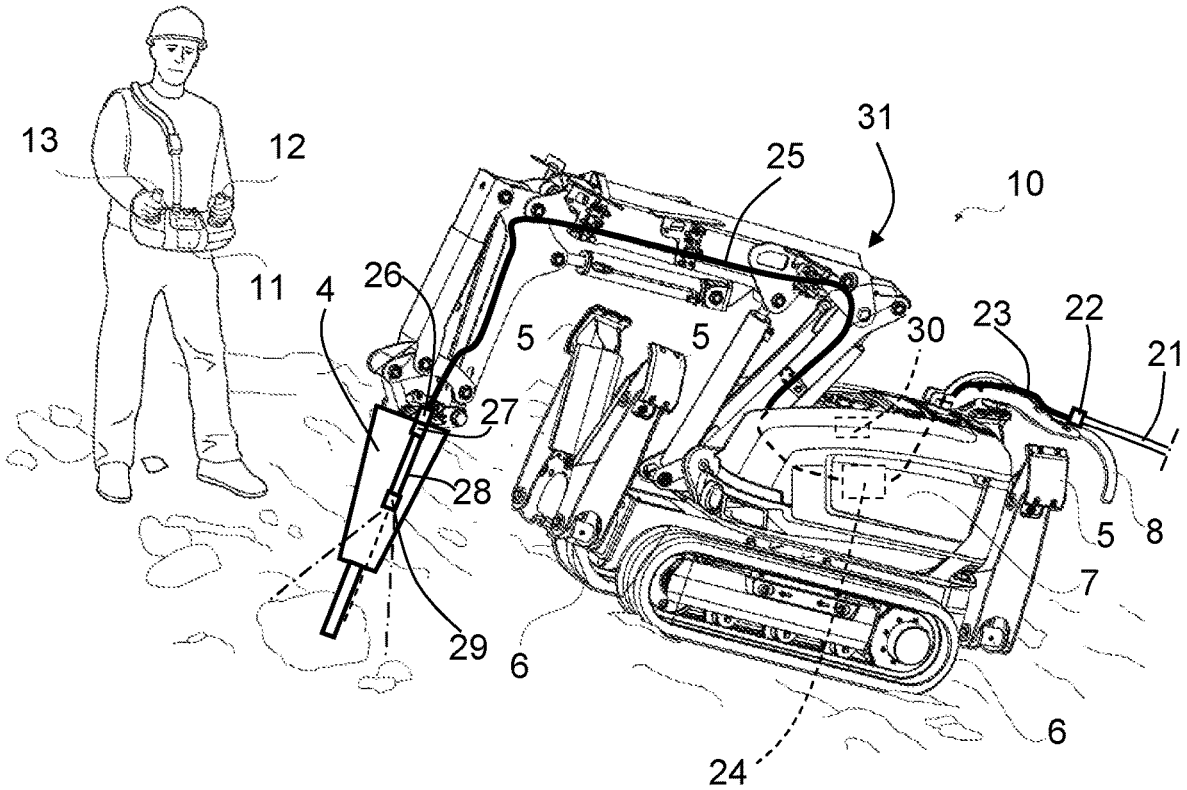
FIG. 1 shows a first view of a demolition robot and a remote control.

With reference to FIG. 1, there is a working machine 10 in the form of a demolition robot which is electrically driven and which has a power cable 8. In the figures, the cable 8 is shown in a detached state, but it is in fact connected to a cable leading to a socket, generally for high-tension current. The machine is driven by caterpillar tracks 6 and has a rotating tower 7. An arm consisting of several parts, which will be described in more detail with reference to FIG. 2, is secured to the tower.

The machine has four support legs 5 which here are shown fully raised. The operator operates the machine with the aid of a remote control 11 which is in this case worn over the operator's shoulders. However, it may of course also be secured in a different manner, e.g. by means of a waist belt. The remote control has a left control stick 12 and a right control stick 13.

Figure 2:
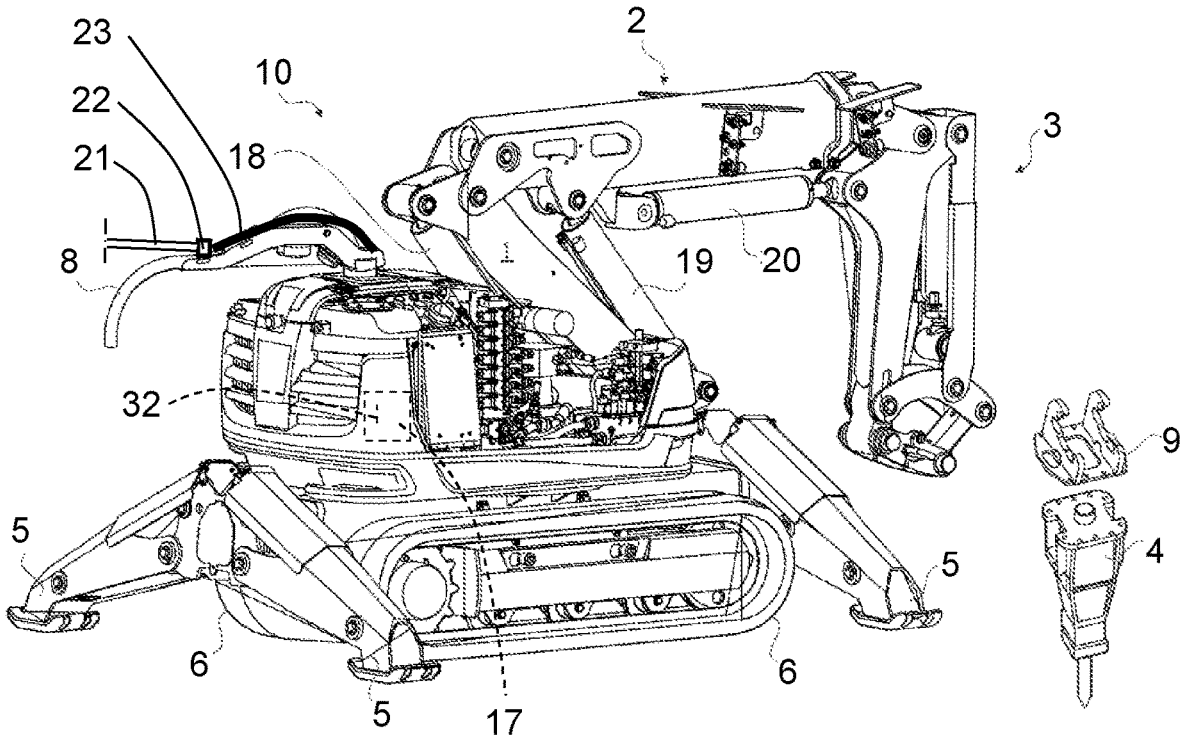
FIG. 2 shows a second view of the demolition robot.

FIG. 2 shows the demolition robot 10 in more detail with some of the protective casings removed. Its support legs 5 are lowered so that the machine rests steady on its four support legs. As mentioned, the machine has an arm consisting of three parts. A first arm 1 is hinged to the rotating tower 7 of the machine and can be swung with the aid of a first hydraulic cylinder 18 the upper end of which is seen in the left part of the arm. A second arm 2 is secured to the first arm 1. It is inclined with the aid of a second hydraulic cylinder 19 on the front side of the first arm 1. The second arm 2 also has an inner telescopically extendable part which increases the range of the machine. It is operated by a hydraulic cylinder which is placed within the second arm 2 and is therefore completely concealed. A third arm 3 is secured to the outer end of the second arm 2, and is swung by a third hydraulic cylinder 20 on the inside of the second arm 2.

The outer end of the third arm 3 is designed in such a manner that it can be secured to a mounting plate 9 mounted on the rear side of a demolition tool 4. For the sake of clarity, the tool 4 and the mounting plate 9 are shown separated from one another and from the outer end of the third arm 3. The tool shown is a breaker 4 for chipping concrete or the like. It can be exchanged for a concrete crusher for breaking and cutting material. In FIG. 1, a schematical breaker 4 is shown mounted.

With reference to both FIG. 1 and FIG. 2, an external water supply in the form of an external water guide 21 is connected to a water inlet 22 at the demolition robot 10, where the water inlet 22 is connected to a first water guide 23 that is connected to, and arranged to guide water to, a controllable valve 24. The controllable valve 24 is in turn connected to a second water guide 25 that is connected to, and arranged to guide water to, a first tool water connection 26 arranged on the third arm 3. The tool 4 comprises a second tool water connection 27 that is connected to a third water guide 28 that ends in a water nozzle 29. When the tool 4 is mounted to the demolition robot 10, the first tool water connection 26 is connected to the second tool water connection 27.

The external water guide 21, the water inlet 22, the first water guide 23, the controllable valve 24, the second water guide 25, the first tool water connection 26, the second tool water connection 27, the third water guide 28 and the water nozzle 29 are all comprised in a water supply arrangement 31.

When the tool 4 is mounted to the demolition robot 10, the external water supply 21 is thus connected to the water nozzle 29 via the controllable valve 24, where the controllable valve 24 is arranged to control the flow of water passing from the first water guide 23 to the second water guide 25. When water is admitted to flow from the first water guide 23 to the second water guide 25 via the controllable valve 24, the controllable valve 24 then being in an open state, water is sprayed out the nozzle 29 and is used for mixing with dust created by the tool 4, such that the created dust is retained. When the controllable valve 24 is in a closed state, water is not admitted to flow from the first water guide 23 to the second water guide 25.

Figure 3:
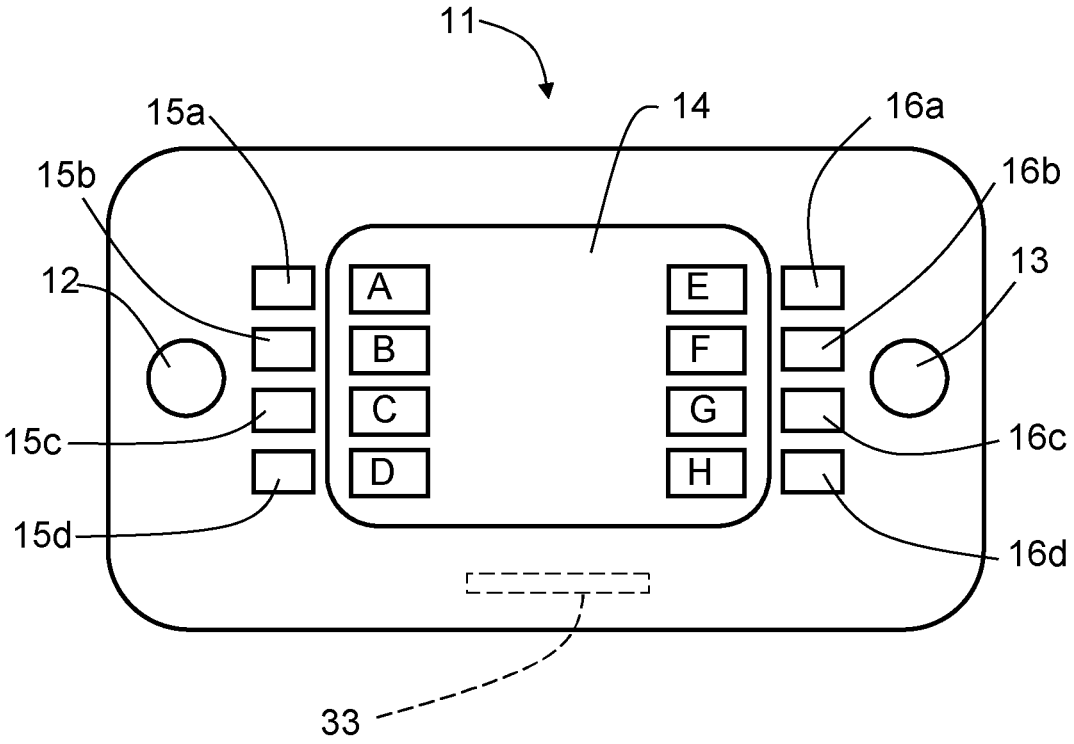
FIG. 3 shows a schematical view of a remote control.

FIG. 3 schematically shows the remote control 11 approximately as it is seen by an operator. It has a left control stick 12 and a right control stick 13. The remote control 11 furthermore has a display 14 and a plurality of buttons, in this case four buttons 15*a*, 15*b*, 15*c*, 15*d* to the left of the display 14 and four buttons 16*a*, 16*b*, 16*c*, 16*d* to the right of the display 14. The buttons 15*a*, 15*b*, 15*c*, 15*d* on the left have the function shown to their right on the display 14, and the buttons 16*a*, 16*b*, 16*c*, 16*d* on the right have the function shown to their left on the display 14.

This means that, when the demolition robot 10 is started, a plurality of modes or positions are shown in corresponding generically indicated fields A, B, C, D; E, F, G, H on the display 11, and the operator selects the modes and positions he wishes to use with the relevant buttons 15*a*, 15*b*, 15*c*, 15*d*; 16*a*, 16*b*, 16*c*, 16*d*. This means that the fields A, B, C, D; E, F, G, H will show different contents in the following, where the generically indicated fields A, B, C, D; E, F, G, H will be used for all the contents described. In case a field is not described to have any contents, it will either be blank or have any other suitable contents.

Initially, there is an initial display setup where the fields A, B, C, D; E, F, G, H correspond to different actions to be taken. A left first field A corresponds to tools to be chosen, and by pressing a first left button 15*a* the display changes such that at least two of the fields A, B, C, D; E, F, G, H correspond to different tools. The presently mounted tool 4, the breaker 4, is chosen by pressing the first left button 15*a* that here corresponds to the first left field A that presently represents the choice of the breaker.

According to the present disclosure, the remote control 11 is arranged for selection of a desired tool, where at least one selectable tool is associated with a certain predefined water setting. Each water setting relates to a certain relative flow of distributed water during a certain time that is related to the time said tool is performing a certain work procedure. The relative flow of distributed water corresponds to at least one of an open controllable valve 24 and a closed controllable valve 24. In this context, a relative flow relates to an available water flow at the controllable valve 24. Between an external water supply and the controllable valve 24, there may be a device for increasing water pressure (not shown). Such a device is according to some aspects in the form of an internal water pump that is arranged to control water pressure and/or water flow.

The predefined water settings may be initially set for the remote control 11 with or without the possibility to change these settings. When the remote control 11 is arranged for programming certain water settings, the remote control 11 is adapted for configuring and saving a certain water supply setting for each tool. In the example in FIG. 3, in the initial display setup, a left second field B relates to water setup. When a corresponding second left button 15*b* is pressed, the display 14 changes such that at least two of the fields A, B, C, D; E, F, G, H again correspond to the different tools. Again, the breaker 4 is chosen by pressing the first left button 15*a*, and the display 14 then changes such that at least two of the fields A, B, C, D; E, F, G, H correspond to different water settings. For example, the first left field A relates to "water on", the second left field B relates to "water off", a third left field C relates to "water auto close", a fourth left field D relates to "water auto open/close", a first right field E relates to "water auto" and a second right field F relates to "nozzle setting".

For "water on", the controllable valve 24 is in an open state when a tool is chosen and the tool is ready for work, or in work.

For "water off", the controllable valve 24 is always in a closed state.

For "water auto close", the controllable valve 24 is in an open state only when a tool is controlled to close, otherwise in a closed state; this setting is only available for tools that are arranged to have an open and close functionality; for example a concrete crusher.

For "water auto open/close", the controllable valve 24 is in an open state both when a tool is controlled to open and when it is controlled to close, otherwise in a closed state; this setting is only available for tools that are arranged to have an open and close functionality, for example a concrete crusher.

For "water auto", the controllable valve 24 is in an open state only when a tool is activated, otherwise in a closed state; this setting is only available for tools that are arranged to work in a single direction, for example a breaker 4 as shown in FIG. 1 and FIG. 2. In this context, an activated tool is a chosen tool that presently is used in work, for example that a scissor tool is opening or closing.

When pressing buttons 15*c*, 15*d*, 16*a* corresponding to the choice of "water auto close", "water auto open/close" and "water auto", the display 14 changes such that extended time options are shown for the first left field A and the second left field B. The first left field A displays a choice "on" and the second left field B displays a choice "off". For the choice "on", being chosen by pressing the corresponding left first button 15*a*, the display 14 changes such that the first left field A displays a choice of a first time period and the second left field B displays a choice of a second time period. The time period chosen by pressing the corresponding button 15*a*, 15*b* corresponds to a time period during which the controllable valve 24 is maintained in an open state after that the tool 4 has been de-activated. Of course, only one or more than two time periods may be shown by means of further fields on the display 14.

Generally, for a certain water setting, there is a relative flow of distributed water during a certain extension time after a certain stop time, after which stop time the work procedure is no longer being performed. Such an extension time is according to some aspects 2-15 seconds, and can according to some aspects be chosen in second-steps.

For "nozzle setting", the nozzle 29 is controlled such that different spray configurations are obtained. When pressing the corresponding button F, the display 14 changes such that different spray options are shown for at least two of the fields A, B, C, D; E, F, G, H; for example "mist", "medium" and "hard". By pressing a corresponding button, the desired spray option is chosen. This functionality of course requires a controllable nozzle 29.

By having individual water function settings for each tool, the demolition robot 10 can be configured once for the tools available, and the saved settings are then automatically used for each individually chosen tool. This means that by choosing a certain tool, the corresponding water settings are automatically applied. The above is only an example of water settings for a set of tools; there may of course be more or less settings and sub-settings, and other settings than those described. As described above, the individual water function settings for each tool can be set once and for all before delivery to a customer; alternatively the user terminal 4 is arranged for programming and saving desired water function settings.

Back at the initial display setup, the field B corresponds to starting operation of the demolition robot 10 in a known manner. Other fields correspond to different running option, also in a known manner. According to some aspects, after any choice, the display can either return to a previous setup or to the initial display setup.

According to some aspects, a right fourth field H always corresponds to a return function, returning to a previous display setup.

Regarding the remote control, not all buttons and control possibilities that normally are present are shown; mainly only those needed for providing an understanding of the present disclosure are shown and discussed. For example, there may be push-buttons on the ends of the control sticks 12, 13, a main circuit breaker, an emergency stop button, a start and stop button for the motor and hydraulic fluid flow rate control. How a remote control for a machine of this kind is configured is well-known and is not discussed further here. It should, however, be noted that for different modes, such as a set-up mode or different work modes, the control sticks 12, 13 can have different functions.

The present disclosure is not limited to the examples above, but may vary freely within the scope of the appended claims.

When the demolition robot is in the form of a remote controlled demolition robot it further comprises a radio module 17 that is used for communicating with the remote control 11, where the radio module and the remote control 11 comprise suitable antennas 32, 33. It is also conceivable that a wired control is used, where such a wire can be connected through or along with the power cable 8. The radio module 17, the controllable valve and other functions are according to some aspects controlled by one or more control units 30.

Although the present disclosure has been described for a demolition robot 10 that is remotely controlled, the present disclosure is applicable for any type of machine with interchangeable tools. According to some aspects, the present disclosure is applicable for an excavating and crushing machine, for example as described in the previously mentioned document JPH 09100636. Here, the operator is working in a driver's seat in a hood in the machine, and the control is not remote, but fixed or removably fixed, and is generally constituted by a user control device 11.

The examples presented above are only disclosed for providing an understanding of the present disclosure. Generally, there is vehicular work machine having a controllable arm arrangement adapted for handling at least two different tools, where there are at least two different water settings available for each tool. The tools can be equipped with one or more water guides that end in nozzles for distributing the water. The controllable arm arrangement can comprise the three arms as described in the example above, but also more or less. There are normally at least two articulated arm parts and corresponding hydraulic cylinders comprised in the controllable arm arrangement. One articulated arm part is associated with at least one hydraulic cylinder.

According to some aspects, there is no water distribution arrangement parts on the tools, and instead of a first tool water connection 26 arranged on the third arm 3, one or more nozzles are arranged along the third arm 3. In this case, the water distribution arrangement comprises fewer parts than in the example described above. There may off course be more parts comprised the water distribution arrangement than in the example described above, for example there may be more water guides and more than one controllable valve or other water valves.

All water guides are in the form of tubes, hoses or the alike.

The first tool water connection 26 and the second tool water connection 27 can be internally arranged in the tool and the third arm 3 in the same way as for possible hydraulic connections.

A certain relative flow of distributed water corresponds to at least an open controllable valve 24 or a closed controllable valve 24. The controllable valve 24 is according to some aspects controllable between one or more different states between the open state and the closed state. In closed state there is no water flow of water from the first water guide 23 to the second water guide 25, and in an open state there is a maximum available flow of water from the first water guide 23 to the second water guide 25. The controllable valve can for this purpose be in any suitable form, for example comprising a solenoid or a step-motor for controlling the water flow. The controllable valve can alternatively be in the form of a controllable water pump that has a close function for stopping the water flow.

The buttons 15*a*, 15*b*, 15*c*, 15*d*; 16*a*, 16*b*, 16*c*, 16*d* and corresponding display fields A, B, C, D; E, F, G, H described constitute only one example of a possible user control device configuration. Water settings can be input by means of a user control device in many other ways, for example by toggling by choices on a display by means of one or two control sticks or by means of an alpha-numerical keyboard. It is also conceivable that the display is touch-sensitive, such that corresponding buttons are not needed.

Generally, the present disclosure relates to a vehicular work machine 10 comprising a controllable arm arrangement 1, 2, 3; 18, 19, 20 that in turn comprises at least two articulated arm parts 1, 2, 3 and is adapted for handling at least two different interchangeable tools 4, where the vehicular work machine 10 also comprises a user control device 11 and a water supply arrangement 31 that is adapted to distribute water with the purpose of retaining dust that is created when a tool 4 is used, where the water supply arrangement 31 comprises a controllable valve 24 that is arranged to control the flow of the water that is distributed via at least one nozzle 29. The user control device 11 is arranged for selection of a desired tool, where at least one selectable tool is associated with a certain predefined water setting, where each water setting relates to a certain relative flow of distributed water during a certain time that is related to the time said tool 4 is chosen and performing a certain work procedure, and/or to the time said tool 4 is chosen and ready to perform a certain work procedure, where said certain relative flow of distributed water corresponds to at least an open controllable valve 24 or a closed controllable valve 24.

According to an example, the user control device 11 is arranged for inputting and saving at least two different water settings for each of said tools 4.

According to an example, said nozzle 29 is positioned on said tool 4.

According to an example, for a certain water setting, there is a relative flow of distributed water during a certain extension time after a certain stop time, after which stop time the work procedure is no longer being performed.

According to an example, said water settings include at least two of:

"water on", where the controllable valve 24 is in an open state when a tool 4 is chosen and said tool 4 is ready for work, or in work;

"water off", where the controllable valve 24 always is in a closed state;

"water auto close", where the controllable valve 24 is in an open state only when an openable and closable tool 4 is controlled to close, otherwise in a closed state;

"water auto open/close", where the controllable valve 24 is in an open state both when an openable and closable tool 4 is controlled to open and when it is controlled to close, otherwise in a closed state;

"water auto", where the controllable valve 24 is in an open state only when a tool 4 is activated, otherwise in a closed state; and "nozzle setting", where the nozzle 29 is controlled such that different spray configurations are obtained.

According to an example, for the water settings "water auto close", "water auto open/close" and "water auto", the user control device 11 is arranged to input and save at least two different extension times, where an extension time corresponds to a time period during which the controllable valve 24 is maintained in an open state after that a tool 4 has been de-activated.

Generally, the present disclosure also relates to a method for vehicular work machine 10 water control, where water is distributed in a controlled manner and used for retaining dust that is created by the work machine 10 when one of at least two interchangeable tools is used. The method comprises selecting a desired tool, where at least one selectable tool is associated with a certain predefined water setting, where each water setting relates to a certain relative flow of distributed water during a certain time that is related to the time a tool 4 is chosen and performing a certain work procedure, and/or to the time said tool 4 is chosen and ready to perform a certain work procedure.

According to an example, the method comprises inputting and saving at least two different water settings for each of said tools 4.

According to an example, for a certain water setting, there is a relative flow of distributed water during a certain extension time after a certain stop time, after which stop time the work procedure is no longer being performed.

According to an example, a controllable valve 24 is used for controlling the water distribution, where said water settings include at least two of:

"water on", where a controllable valve 24 in an open state when a tool 4 is chosen and said tool 4 is ready for work, or in work;

"water off", where the controllable valve 24 always is in a closed state;

"water auto close", where the controllable valve 24 is in an open state only when an openable and closable tool 4 is controlled to close, otherwise in a closed state;

"water auto open/close", where the controllable valve 24 is in an open state both when an openable and closable tool 4 is controlled to open and when it is controlled to close, otherwise in a closed state;

"water auto", where the controllable valve 24 is in an open state only when a tool 24 is activated, otherwise in a closed state; and "nozzle setting", where the nozzle 29 is controlled such that different spray configurations are obtained.

According to an example, when the water settings "water auto close", "water auto open/close" and "water auto" are used, the method further comprises inputting and saving at least two different extension times, where an extension time corresponds to a time period during which the controllable valve 24 is maintained in an open state after that a tool 4 has been de-activated.

The invention claimed is:

1. A vehicular work machine comprising a controllable arm arrangement that in turn comprises at least two articulated arm parts and is adapted for handling at least two different interchangeable tools, wherein the vehicular work machine also comprises a user control device and a water supply arrangement that is adapted to distribute water with the purpose of retaining dust that is created by use of a tool of the at least two different interchangeable tools, wherein the water supply arrangement comprises a controllable valve that is arranged to control the flow of the water that is distributed via at least one nozzle, wherein the user control device is arranged for selection of a desired tool of the at least two different interchangeable tools, wherein at least one selectable tool of the at least two different interchangeable tools is associated with an initial water setting, wherein each initial water setting defines parameters for activating an initial relative flow of distributed water, wherein the user control device is configured to allow an operator to change the respective initial water settings for the at least two different interchangeable tools, and to save new water settings for the at least two different interchangeable tools, each new water setting defines new parameters for activating a new relative flow of distributed water, wherein each initial water setting and each new water setting comprises a time period for activating the relative flow of distributed water without direct operator interaction, wherein the time period corresponds to an amount of time a tool of the at least two different interchangeable tools is chosen and performing a certain work procedure, and/or to an amount of time said tool of the at least two different interchangeable tools is chosen and ready to perform the certain work procedure, and wherein the initial relative flow of distributed water and the new relative flow of distributed water corresponds to the controllable valve being at least open or closed.

2. A vehicular work machine according to claim 1, wherein the user control device is arranged for inputting and saving at least two different water settings for each of the tools of the at least two different interchangeable tools.

3. A vehicular work machine according to claim 1, wherein said nozzle is positioned on said tool of the at least two different interchangeable tools.

4. A vehicular work machine according to claim 1, wherein, for a certain water setting, there is a relative flow of distributed water during a certain extension time after a certain stop time, after which stop time the work procedure is no longer being performed.

5. A vehicular work machine according to claim 2, wherein said water settings include at least two of:

"water on", where the controllable valve is in an open state when the tool of the at least two different interchangeable tools is chosen and said tool of the at least two different interchangeable tools is ready for work, or in work;

"water off", where the controllable valve always is in a closed state;

"water auto close", where the controllable valve is in the open state only when an openable and closable tool of the at least two different interchangeable tools is controlled to close, otherwise in the closed state;

"water auto open/close", where the controllable valve is in the open state both when the openable and closable tool of the at least two different interchangeable tools is controlled to open and when the openable and closable tool of the at least two different interchangeable tools is controlled to close, otherwise in the closed state;

"water auto", where the controllable valve is in the open state only when the tool of the at least two different interchangeable tools is activated, otherwise in the closed state; and "nozzle setting", where the nozzle is controlled such that different spray configurations are obtained.

6. A vehicular work machine according to claim 5, wherein, for the water settings "water auto close", "water auto open/close" and "water auto", the user control device is arranged to input and save at least two different extension times, where an extension time corresponds to a time period during which the controllable valve is maintained in the open state after that the tool of the at least two different interchangeable tools has been de-activated.

7. A vehicular work machine comprising a controllable arm arrangement that in turn comprises at least two articulated arm parts and is adapted for handling at least two different interchangeable tools, wherein the vehicular work machine also comprises a user control device and a water supply arrangement that is adapted to distribute water with the purpose of retaining dust that is created by use of a tool of the at least two different interchangeable tools, wherein the water supply arrangement comprises a pump in operative communication with a controllable valve that is arranged to control the flow of the water that is distributed via at least one nozzle, the controllable valve is controllable from a closed state, to an open state, and between one or more different states between the open state and the closed state, wherein the user control device is arranged for selection of a desired tool of the at least two different interchangeable tools, wherein at least one selectable tool of the at least two different interchangeable tools is associated with a certain initial water setting, wherein each initial water setting defines parameters for activating a relative flow of distributed water, wherein each initial water setting is applied based on the selection of a desired tool of the at least two interchangeable tools, wherein each initial water setting comprises a time period for activating the relative flow of distributed water without direct operator interaction, wherein the time period corresponds to an amount of time a tool of the at least two different interchangeable tools is chosen and performing a certain work procedure, and/or to an amount of time said tool of the at least two different interchangeable tools is chosen and ready to perform the certain work procedure, and wherein said certain relative flow of distributed water corresponds to the controllable valve being at the closed state, the open state, or between the open state and the closed state.

8. A vehicular work machine according claim 7, wherein the at least one nozzle is a controllable nozzle controlled such that different spray configurations are obtained.

* * * * *